US006216913B1

(12) United States Patent
Bilskie et al.

(10) Patent No.: US 6,216,913 B1
(45) Date of Patent: Apr. 17, 2001

(54) SELF-CONTAINED PNEUMATIC BEVERAGE DISPENSING SYSTEM

(75) Inventors: Richard P. Bilskie; Edward N. Oyler, both of Newnan; Harold F. Stover, Grantville, all of GA (US)

(73) Assignee: S.O.B. Partnership, Newnan, GA (US)

( * ) Notice: Subject to any disclaimer, the term of this patent is extended or adjusted under 35 U.S.C. 154(b) by 0 days.

(21) Appl. No.: 09/353,862

(22) Filed: Jul. 15, 1999

Related U.S. Application Data

(63) Continuation-in-part of application No. 08/965,711, filed on Nov. 7, 1997, now Pat. No. 6,021,922.
(60) Provisional application No. 60/030,628, filed on Nov. 8, 1996.

(51) Int. Cl.[7] ..... B67D 5/08
(52) U.S. Cl. ..... 222/67; 222/129.2; 222/136; 222/400.7
(58) Field of Search ..... 222/399, 146.6, 222/136, 386.5, 129.1, 129.2, 51, 67, 400.7, 608

(56) References Cited

U.S. PATENT DOCUMENTS

| | | | | |
|---|---|---|---|---|
| 4,313,897 | | 2/1982 | Garrard | 261/64 |
| 5,176,298 | * | 1/1993 | Mogler et al. | 222/400.7 |
| 5,246,140 | * | 9/1993 | Thix et al. | 222/399 |
| 5,411,179 | | 5/1995 | Oyler et al. | 222/129 |
| 5,553,749 | | 9/1996 | Oyler et al. | 222/129.1 |

OTHER PUBLICATIONS

Anne O'Neill, "Beverage Cart with Ambition to Fly," Atlanta Business Chronicle, May 21–27, 1999.
A Revolution in the Air, Coming Soon: The World's First Onboard Post Mix Beverage Cart, Onboard Services The International Trade Publication for the Passenger Service and Duty–Free Magazine, vol. 31, No. 2, Apr. 1999.
Sterling Beverage Systems, Inc., http://www.sterlingbeverage.com/, 1999 website.

* cited by examiner

*Primary Examiner*—Philippe Derakshani
(74) *Attorney, Agent, or Firm*—Thomas, Kayden, Horstemeyer & Risley L.L.P.

(57) ABSTRACT

The present disclosure concerns a self-contained, pneumatic beverage dispensing system. In one embodiment, the pneumatic beverage dispensing system comprises a carbonator tank for facilitating absorption of $CO_2$ gas in water to produce carbonated water, a source of $CO_2$ gas under high pressure, the source of $CO_2$ gas being in fluid communication with the carbonator tank so as to fill the carbonator tank with $CO_2$ gas, and a source of water under high pressure, the source of water being in fluid communication with the carbonator tank so as to fill the carbonator tank with water. The system normally further comprises at least two liquid containers for containing liquids to be dispensed by the dispensing system, one of the liquid containers being in fluid communication with the source of $CO_2$ gas, and a pneumatic pump system in fluid communication with the source of $CO_2$ gas and the other of the liquid containers. In operation, the pneumatic pump system receives high pressure $CO_2$ gas from the source of $CO_2$ gas and uses it to pressurize air that is supplied to the other of the liquid containers.

33 Claims, 12 Drawing Sheets

SELF-CONTAINED PNEUMATIC BEVERAGE DISPENSING SYSTEM

CROSS-REFERENCE TO RELATED APPLICATIONS

The present application claims the benefit of the filing date of U.S. Provisional Application Serial No. 60/030,628, filed Nov. 8, 1996, and is a Continuation-in-Part of U.S. patent application Ser. No. 08/965,711, filed Nov. 7, 1997, now U.S. Pat. No. 6,021,922.

FIELD OF THE INVENTION

The present invention relates generally to a beverage dispensing system. More particularly, the present invention relates to a self-contained, high pressure pneumatic beverage dispensing system especially adapted for use on commercial aircraft, railcars, ships, and the like, as well as for installation in golf carts and other such small vehicles.

BACKGROUND OF THE INVENTION

Conventionally, beverage dispensing systems require electrical or gasoline power. Therefore, these systems tend to be bulky and usually are unsuitable for portable applications. Typically, such conventional beverage dispensing systems comprise a high pressure carbonator tank plumbed to a carbon dioxide ($CO_2$) cylinder through a pressure regulator in which the pressure to be supplied to the carbonator tank is reduced to approximately 90 pounds per square inch (psi). A motorized pump plumbed to a fixed water tap system is used to pressurize the water supplied to the tank to approximately 200 psi. The high pressure water flows into the carbonator tank, overcoming the rising pressure of the $CO_2$ gas contained therein. As the carbonator tank fills with this high pressure water, a pocket of $CO_2$ gas that exists above the water is compressed, forcing the $CO_2$ gas to be absorbed into the water, thereby creating carbonated water.

In that the conventional beverage dispensing systems described above require a constant source of power to operate the pump motor, use of such systems is generally limited to fixed installations. Although portable beverage dispensing systems that do not require electrical or gasoline powered pumps have been developed, these systems have several disadvantages. One such system is disclosed in U.S. Pat. No. 5,411,179 (Oyler et al.) and U.S. Pat. No. 5,553,749 (Oyler et al.). Similar to the systems described in the present disclosure, the systems described in these patents use high pressure $CO_2$ gas supplied by a $CO_2$ tank to pressurize the water that is supplied to a carbonator tank. Unlike the systems described in the present disclosure, however, the systems described in these patent references use low pressure carbonator tanks which typically operate at pressures below 100 psi.

Despite providing for some degree of water carbonation (typically approximately 2.5%), known systems typically do not produce beverages having a commercially acceptable level of carbonation (generally between 3.0% to 4.0%). Experimentation has shown that the pressurized water often must be cooled to a low temperature prior to entering the carbonator tank of these systems to achieve fill absorption of $CO_2$ gas into the water. Moreover, the $CO_2$ gas that is absorbed into the carbonated water can quickly be diffused from the water when it is heated to a warmer temperature. Accordingly, when the carbonated water is post-mixed with relatively warm liquids, such as concentrated syrups, juices, and the like, the relatively small amount of carbonation of the water quickly can be lost.

It therefore can be appreciated that it would be desirable to have a self-contained beverage dispensing system that is portable and which produces beverages having a commercially acceptable level of stable carbonation.

SUMMARY OF THE INVENTION

Briefly described, the present invention relates to a self-contained, pneumatic beverage dispensing system. In one embodiment, the pneumatic beverage dispensing system comprises a carbonator tank for facilitating absorption of $CO_2$ gas in water to produce carbonated water, a source of $CO_2$ gas under high pressure, the source of $CO_2$ gas being in fluid communication with the carbonator tank so as to fill the carbonator tank with $CO_2$ gas, and a source of water under high pressure, the source of water being in fluid communication with the carbonator tank so as to fill the carbonator tank with water. The system normally further comprises at least two liquid containers for containing liquids to be dispensed by the dispensing system, one of the liquid containers being in fluid communication with the source of $CO_2$ gas, and a pneumatic pump system in fluid communication with the source of $CO_2$ gas and the other of the liquid containers. In operation, the pneumatic pump system receives high pressure $CO_2$ gas from the source of $CO_2$ gas and uses it to pressurize air that is supplied to the other of the liquid containers. Finally, the system further includes a beverage dispensing valve in fluid communication with the carbonator tank and the at least two liquid containers, the dispensing valve used to dispense carbonated water from the carbonator tank and the liquids contained in the at least two liquid containers.

The features and advantages of this invention will become apparent upon reading the following specification, when taken in conjunction with the accompanying drawings.

BRIEF DESCRIPTION OF THE DRAWINGS

The invention can be better understood with reference to the following drawings. The components in the drawings are not necessarily to scale, emphasis instead being placed upon clearly illustrating the principles of the present invention.

DETAILED DESCRIPTION

Referring now in more detail to the drawings, in which like numerals indicate corresponding parts throughout the several views, FIGS. 1–12 illustrate various components of a first embodiment of a self-contained pneumatic beverage dispensing system 10 constructed in accordance with the present invention.

Figure 1:
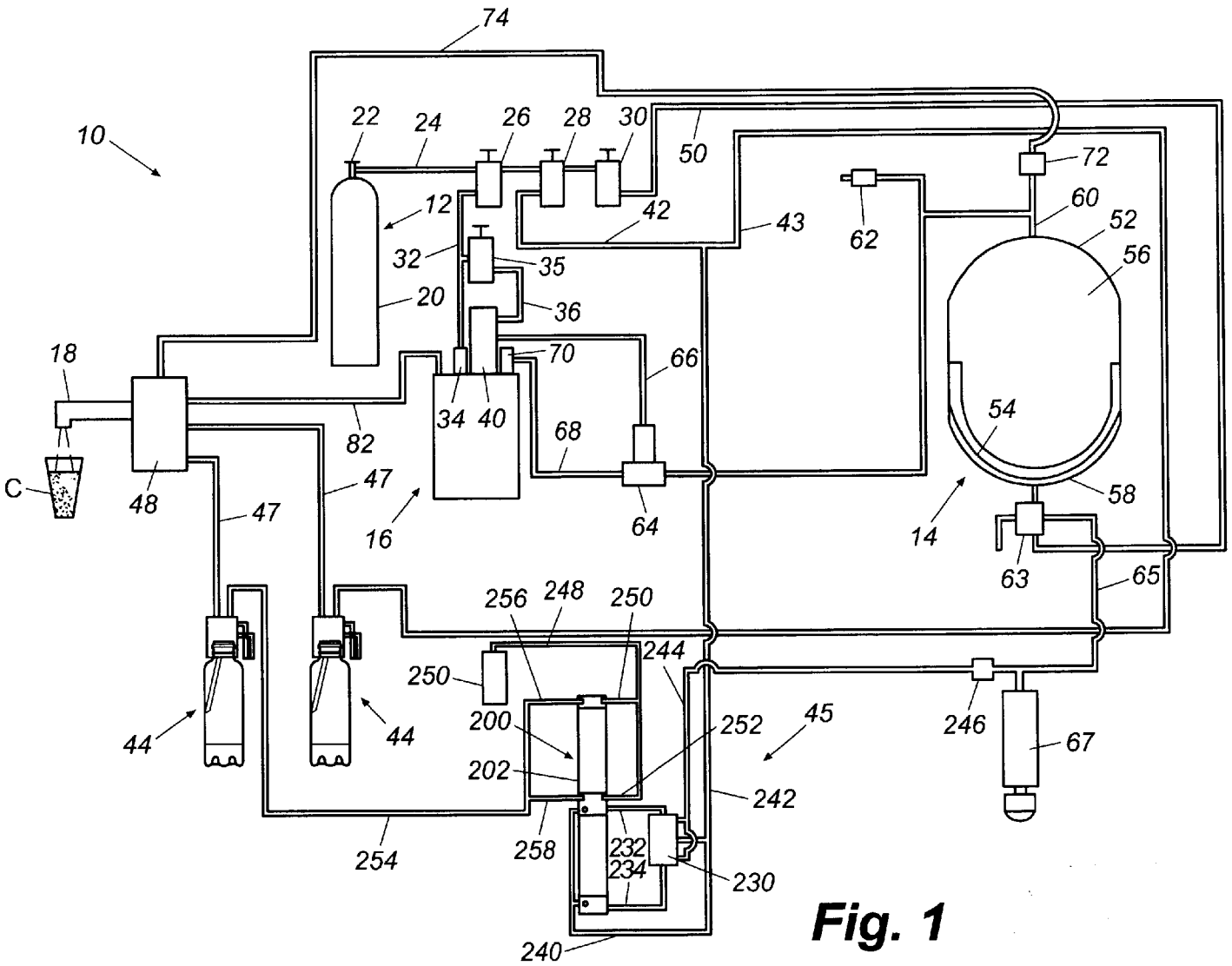
FIG. 1 is a schematic view of a first embodiment of a self-contained pneumatic beverage dispensing system constructed in accordance with the present invention.

FIG. 1 is a schematic view of the first embodiment of the self-contained pneumatic beverage dispensing system 10. The system 10 generally comprises a source 12 of $CO_2$ at high pressure, a source 14 of high pressure water, a high pressure carbonator tank 16, and a beverage dispensing valve 18. The source 12 of $CO_2$ typically comprises a conventional refillable gas storage tank 20 that is filled with pressurized $CO_2$ gas. As is discussed in more detail below, the pressurized $CO_2$ gas contained within the gas storage tank 20 is used for various purposes including carbonating water in the carbonator tank 16, pressurizing water to be supplied to the carbonator tank, and pressurizing various drink syrups and juices.

The $CO_2$ gas exits the gas storage cylinder 20 through a gas shut-off valve 22. When the gas shut-off valve 22 is open, $CO_2$ gas travels through a gas outlet 24 and is supplied to three separate gas pressure regulators 26, 28, and 30. The gas traveling through the first pressure regulator 26 is reduced in pressure to approximately 95 psi and then travels to a supply line 32. The supply line 32 directs the $CO_2$ gas to a gas inlet check valve 34 of the high pressure carbonator tank 16 so that the carbonator tank can be filled with pressurized $CO_2$ gas. In addition, the gas is directed to a fourth pressure regulator 35. The $CO_2$ gas that travels through the fourth gas pressure regulator 35 further is reduced in pressure to approximately 75 psi. After exiting the fourth gas pressure regulator 35, the $CO_2$ gas flows into a supply line 36 which is connected to a carbonator tank water level switch 40, the configuration and operation of which is described below.

The $CO_2$ gas that travels through the second gas pressure regulator 28 is reduced in pressure to approximately 45 psi. After passing through this regulator 28, the gas enters supply line 42. As indicated in FIG. 1, this supply line 42 branches into two branches 43 and 242 such that the 45 psi gas communicates with one or more containers 44, and with a pneumatic pump system 45 that is used to pressurize one or more other containers 44. The containers 44 are connected to supply lines 47 that, in turn, are connected to a cold plate 48 which cools the liquids that flow from the containers to an appropriate mixing or serving temperature. From the cold plate 48, the liquids can be discharged through the beverage dispensing valve 18. A detailed description of the pneumatic pump system 45 as well as the containers 44 is provided below.

The $CO_2$ gas supplied to the third gas pressure regulator 30 is lowered in pressure to approximately between 195 psi to 200 psi. After passing through the third gas pressure regulator 30, the $CO_2$ gas is ported through a gas supply line 50 that supplies this gas to the high pressure water source 14. In the first embodiment shown in FIGS. 1–12, the water source 14 comprises a high pressure water tank 52. Although capable of alternative configurations, this water tank 52 typically is constructed of a strong metal such as stainless steel. Inside the water tank 52 is a flexible diaphragm 54 that separates the interior of the water tank into two separate chambers 56 and 58. The first or water chamber 56 of the water tank is adapted to store water that will be supplied to the carbonator tank 16 for carbonization. The second or gas chamber 58 is adapted to receive high pressure gas that is used to pressurize the water contained in the water chamber 56. The flexible diaphragm 54 completely isolates each chamber from the other such that no mixture of the water and $CO_2$ gas can occur.

Connected to the water chamber side of the water tank 52 is a water supply line 60. Among other functions discussed below, the water supply line 60 is used to refill the water chamber 56 of the water tank 52. To refill this chamber, a refill inlet check valve 62 connected to a branch of the water supply line 60 is connected to a source of water having positive head pressure which, depending upon personal preferences, can be a source of purified water or a standard tap water source. Positioned along the supply line 50 between the third gas pressure regulator 30 and the water tank 52 is a three-way vent valve 63. The three-way vent valve 63 is manually operable to control the pressurization or depressurization of the gas chamber 58 of the water tank 52. When switched to an open position, the three-way vent valve 63 directs high pressure $CO_2$ gas into the gas chamber 58 of the water tank 52 which urges the pliable diaphragm 54 against the volume of water contained in the water chamber 56 to increase the pressure of the water to a level within the range of approximately between 195 psi to 200 psi. When the operator wishes to refill the tank 52 with water, the three-way vent valve 63 is manually switched to a closed position in which the supply of high pressure $CO_2$ gas to the tank 52 is shut-off and the high pressure gas contained in the gas chamber 58 of the water tank is vented to the atmosphere to relieve the pressure therein. Preferably, this gas is first directed to a first vent line 65 which leads to a diffuser 67 which, as is known in the art, gradually diffuses the vented gas into the atmosphere to reduce noise. Once the pressure within the tank 52 is reduced, the operator can refill the tank with any water source capable of supplying water at a positive bead pressure.

In addition to providing for refilling of the water tank 52, the water supply line 60 further is used to transport the pressurized water in two separate directions. In a first direction, the water is supplied to a water valve 64 that is positioned intermediate the water tank 52 and the carbonator tank 16. Typically, the water valve 64 is pneumatically actuated to open or close to thereby permit or prevent the flow of water therethrough. In a preferred arrangement, the water valve 64 comprises a normally closed, gas actuated, high pressure bellows valve. Considered suitable for this use are HB Series bellows valves manufactured by Nupro. Coupled with a pneumatic signal line 66, the water valve 64 and water level switch 40 are in fluid communication with one another. When supplied with a pneumatic pressure signal sent from the water level switch 40, the water valve 64 opens, permitting high pressure water supplied by the water tank 52 to pass through the valve and into a carbonator tank supply line 68. In use, the water is transported into the tank 16 through a water inlet check valve 70 that is mounted to the carbonator tank.

In addition to transporting high pressure water in the first direction to the water valve 64, the water supply line 60 transports high pressure water in a second direction to a water pressure regulator 72. This pressure regulator 72 reduces the pressure of the water supplied from the water tank to approximately 45 psi to 60 psi. From the water pressure regulator 72, the water flows through a flat water supply line 74 and then through the cold plate 48 to be dispensed by the beverage dispensing valve 18 when activated by the operator.

Figure 2:
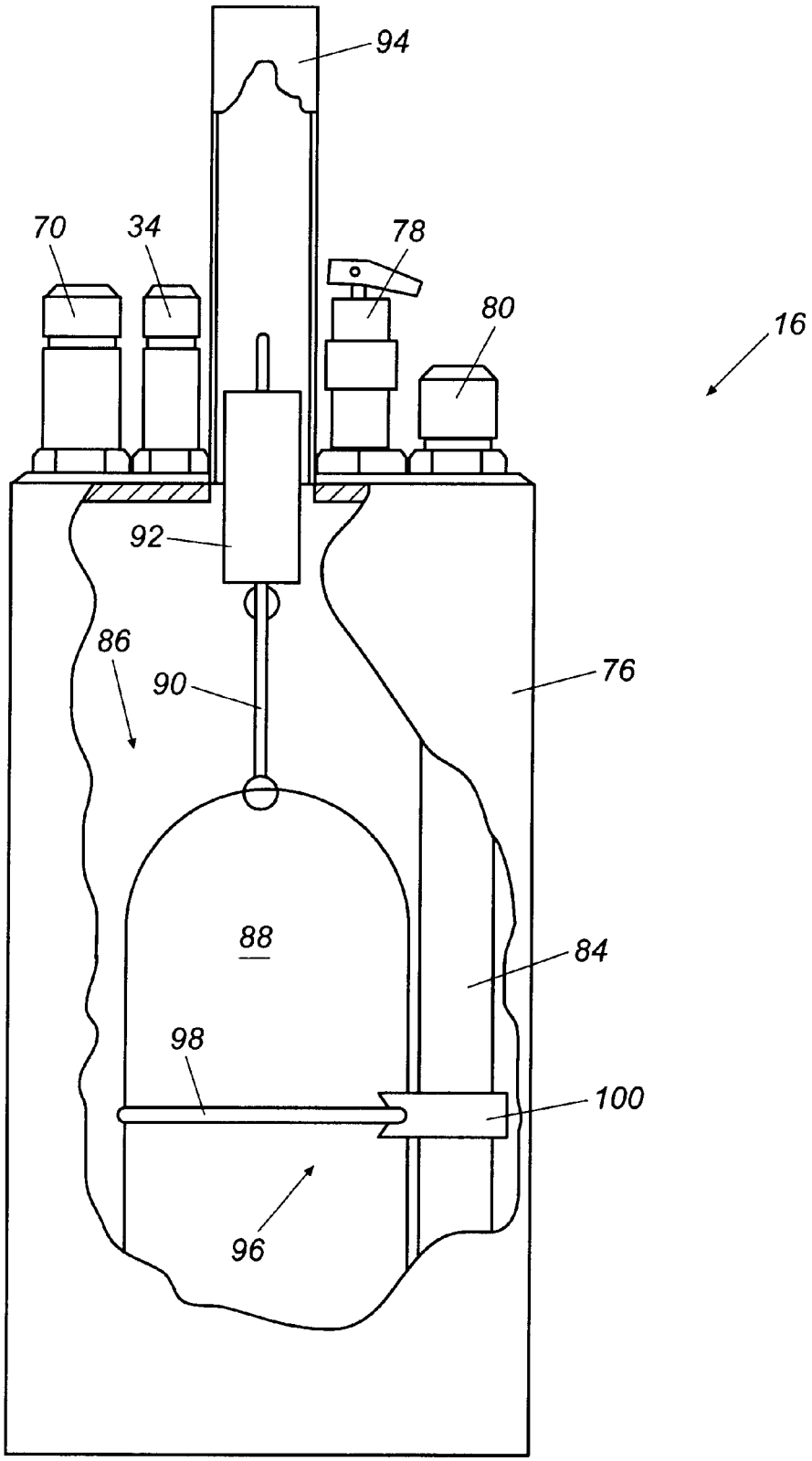
FIG. 2 is a cut-away side view of a high pressure carbonator tank used in the beverage dispensing system of FIG. 1.

FIG. 2 illustrates, in cut-away view, the carbonator tank 16 preferred for use in the embodiment shown in FIGS. 1–12. As depicted in the figure, the carbonator tank 16 comprises a generally cylindrical tank 76. Mounted to the top of the cylindrical tank 76 are the gas inlet check valve 34 and the water inlet check valve 70 as well as a safety relief valve 78, all of which are of conventional design. Further mounted to the top of the carbonator tank 16 is a carbonated water outlet 80 that is fluidly connected to a carbonated water supply line 82 (FIG. 1). Inside the carbonator tank 16 is a carbonated water supply tube 84 that extends from the bottom of the tank up to the carbonated water outlet 80 such that, when the beverage dispenser valve 18 is activated to produce carbonated water, the pressurized carbonated water from the bottom of the carbonator tank is forced through the supply tube 84, out of the carbonated water outlet 80, through the carbonated water supply line 82, through the cold plate 48, and finally out of the dispensing valve into a suitable beverage container C.

The carbonator tank 16 further comprises a mechanical water level indicator 86. This indicator 86 includes a hollow float member 88 having a rod 90 extending upwardly from the top portion of the float member. Positioned on the top of the rod 90 is a magnetic member 92 normally in the form of a magnetic cylinder. When the carbonator tank 16 is empty, the float member 88 rests on the bottom of the carbonator tank. While the tank is situated in this empty configuration, part of the magnetic member 92 is positioned within the tank and part is positioned within an elongated hollow tube 94 that extends upwardly from the top of the carbonator tank. This hollow tube 94 permits travel of the rod 90 and magnetic member 92 in the upward direction, the purpose for which will be explained herein. Presently considered to be in accordance with the above description is the Model M-6 carbonator available from Jo-Bell.

As the carbonator tank 16 is filled with water, the buoyancy of the float member 88 causes it to float towards the top of the tank. To maintain the float member 88, rod 90, and magnetic member 92 in correct orientation, a mechanical stabilizer 96 is provided. As illustrated in the figure, the stabilizer 96 can comprise a retainer band 98 that is wrapped around the float member 88 and a slide member 100 which is disposed about the carbonated water supply tube 84 and to which the retainer band is fixedly attached. Configured in this manner, the float member 88 will continue to rise within the carbonator tank 16 as the water level within the tank increases. Similarly, the magnetic member 92 will rise within the elongated hollow tube 94 so that water level sensing means can detect when the tank 16 is full, so that water flow into the tank can be halted.

Figure 4:
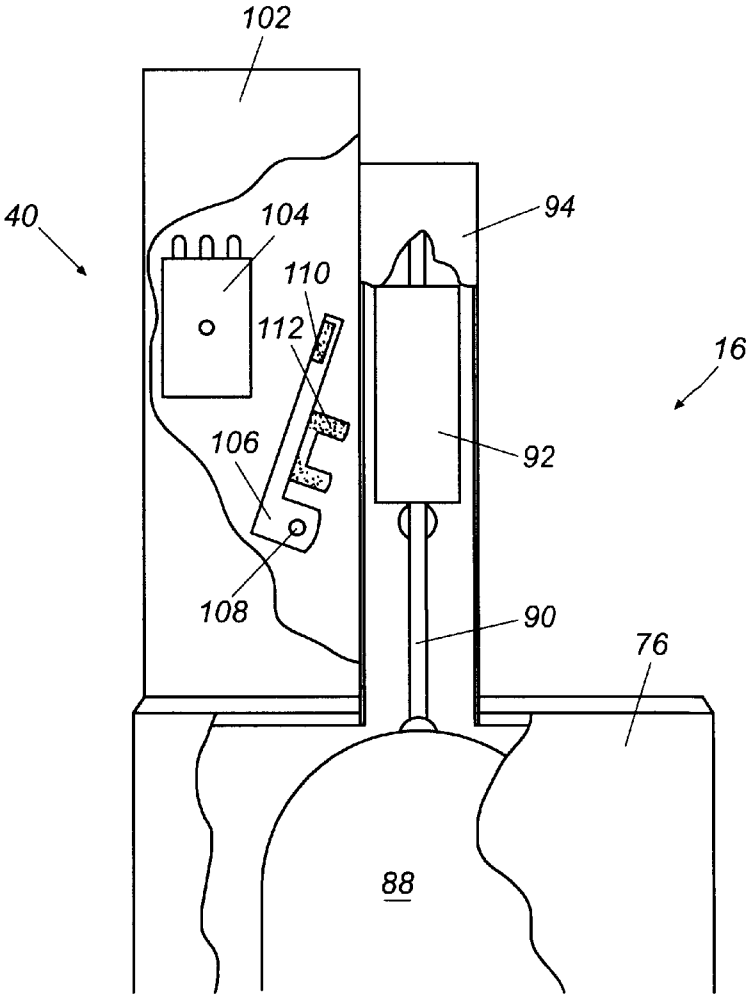
FIG. 4 is a cut-away side view of the carbonator tank of FIGS. 2–3 showing the pneumatic water level switch in the inactivated or full position.
Figure 3:
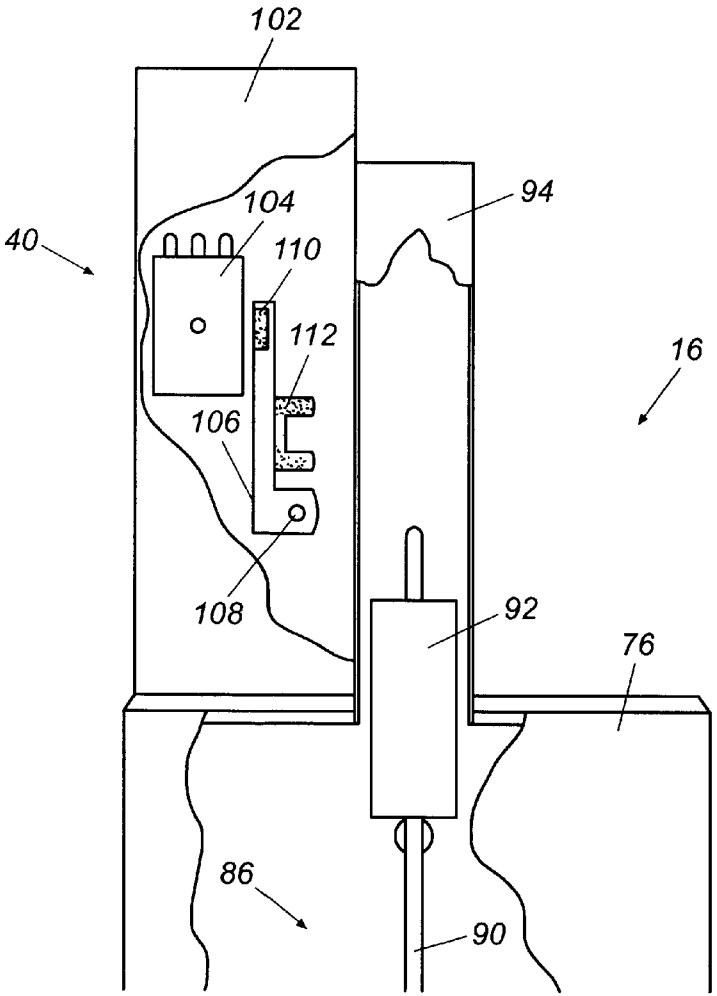
FIG. 3 is a cut-away side view of the carbonator tank of FIG. 2 with a pneumatic water level switch mounted thereto, this switch also shown in cut-away view to depict the activated or fill position of the switch.

As described above, the water level within the tank 16 is monitored and controlled by a carbonator tank water level switch 40 that is mounted to the carbonator tank. FIGS. 3 and 4 illustrate the water level switch 40 and part of the carbonator tank in cut-away view. Preferably, the water level switch 40 comprises an outer housing 102 that is adapted to be positioned in close proximity to the hollow cylinder 94 of the carbonator tank 16. Located within the housing 102 is a pneumatic three-way magnetic proximity switch 104 and a lever arm 106. While the proximity switch 104 is fixed in position within the housing 102, the lever arm 106 is free to pivot about a pivot point 108 such that the lever arm is pivotally mounted within the water level switch 40. Mounted to the lever arm 106 are first and second magnets 110 and 112. The first magnet 110 is mounted to the arm at a position in which it is adjacent the proximity switch 104 when the lever arm is vertically oriented as shown in FIG. 3.

Being attracted to the proximity switch 104, the first magnet 110 maintains the lever arm 106 in the vertical orientation when the tank 16 is not full. When the lever arm 106 is in this vertical orientation, positive contact is made with the proximity switch 104, thereby activating the switch and causing it to send a pneumatic pressure signal to the water valve 64 to remain open so that the carbonator tank 16 can be filled. As the water level rises, however, the magnetic member 92 within the hollow tube 94 rises, eventually moving to a position in which it is adjacent the second magnet 112 mounted on the lever arm. Since the magnetic member 92 is constructed of a magnetic metal, such as magnetic stainless steel, the second magnet 112 of the lever arm 106 is attracted to the cylinder. In that the attractive forces between the second magnet 112 and the magnetic member 92 are greater than those between the first magnet 110 and the proximity switch 104, the lever arm 106 pivots toward the magnetic member 92 as depicted in FIG. 4. By pivoting in this direction, magnetic contact between the first magnet 110 and the proximity switch 104 is interrupted, thereby deactivating the proximity switch and shutting-off the supply of pressurized $CO_2$ gas to the water valve 64, causing the normally closed valve to cut-off the flow of water to the carbonator tank 16.

Figure 5:
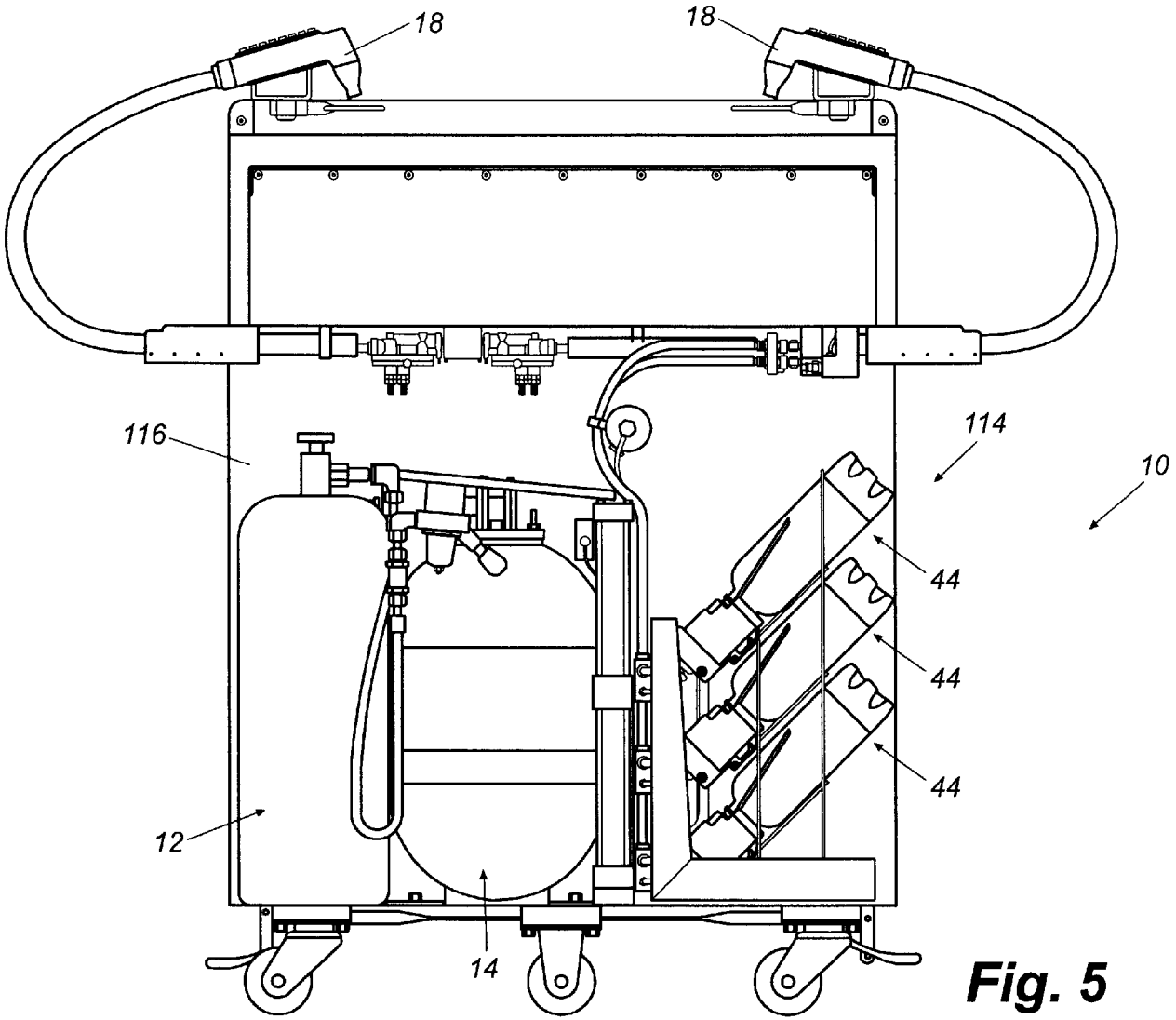
FIG. 5 is a side view of a cart-mounted version of the beverage dispensing system of FIG. 1.
Figure 6:
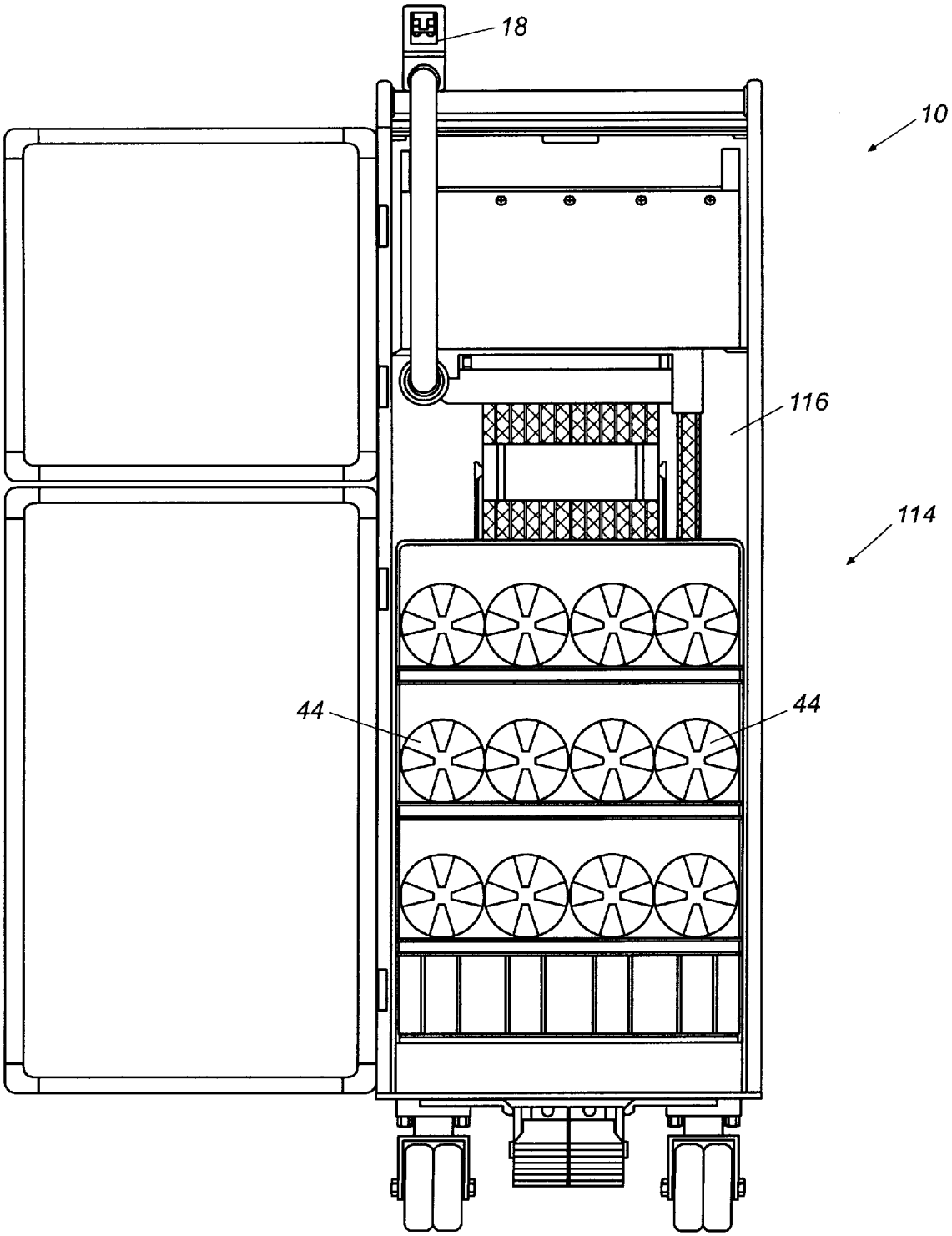
FIG. 6 is an end view of the cart-mounted version of the beverage dispensing system of FIG. 5.

FIGS. 5 and 6 illustrate the beverage dispensing system 10 of FIG. 1 integrated with a cart 114 suitable for use on a passenger vehicle such as an airplane. As indicated in this figure, the cart 114 comprises an interior compartment 116 that houses the majority of the system components including the source 12 of $CO_2$ and the source 14 of high pressure water. Also stored in this compartment 116 is a plurality of the containers 44 identified in FIG. 1. As indicated most clearly in FIG. 7, each of the containers 44 typically comprises a bottle 118 and a bottle coupler 120 which, when disposed in a cart as shown in FIGS. 5 and 6, can be stored within the compartment 116 in an inverted orientation. The bottle 118 normally is formed from a polymeric material and is provided with a mouth 122, a shoulder 124, and a neck 126.

Figure 8:
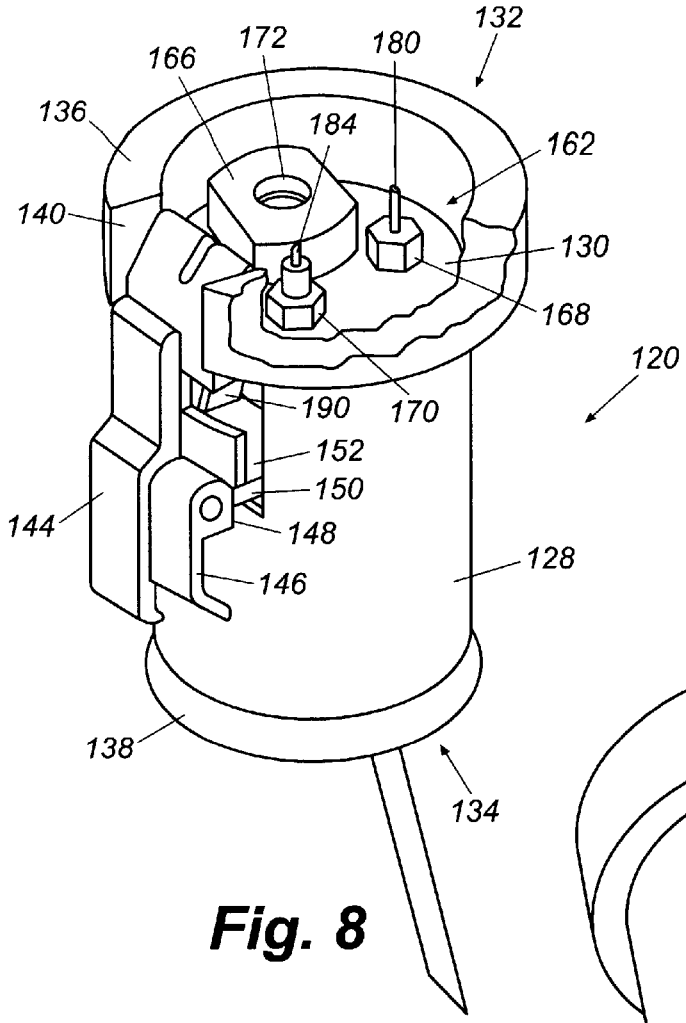
FIG. 8 is an upper perspective view of a bottle coupler shown in FIG. 5, the coupler being depicted in the closed position.
Figure 9:
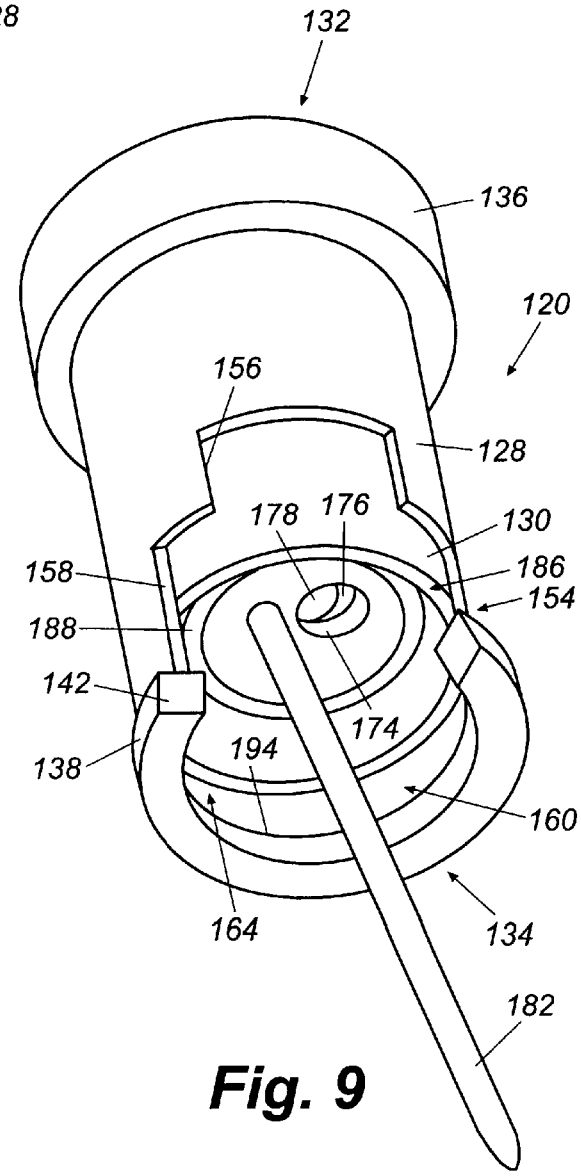
FIG. 9 is a lower perspective view of the bottle coupler of FIG. 8.
Figure 10:
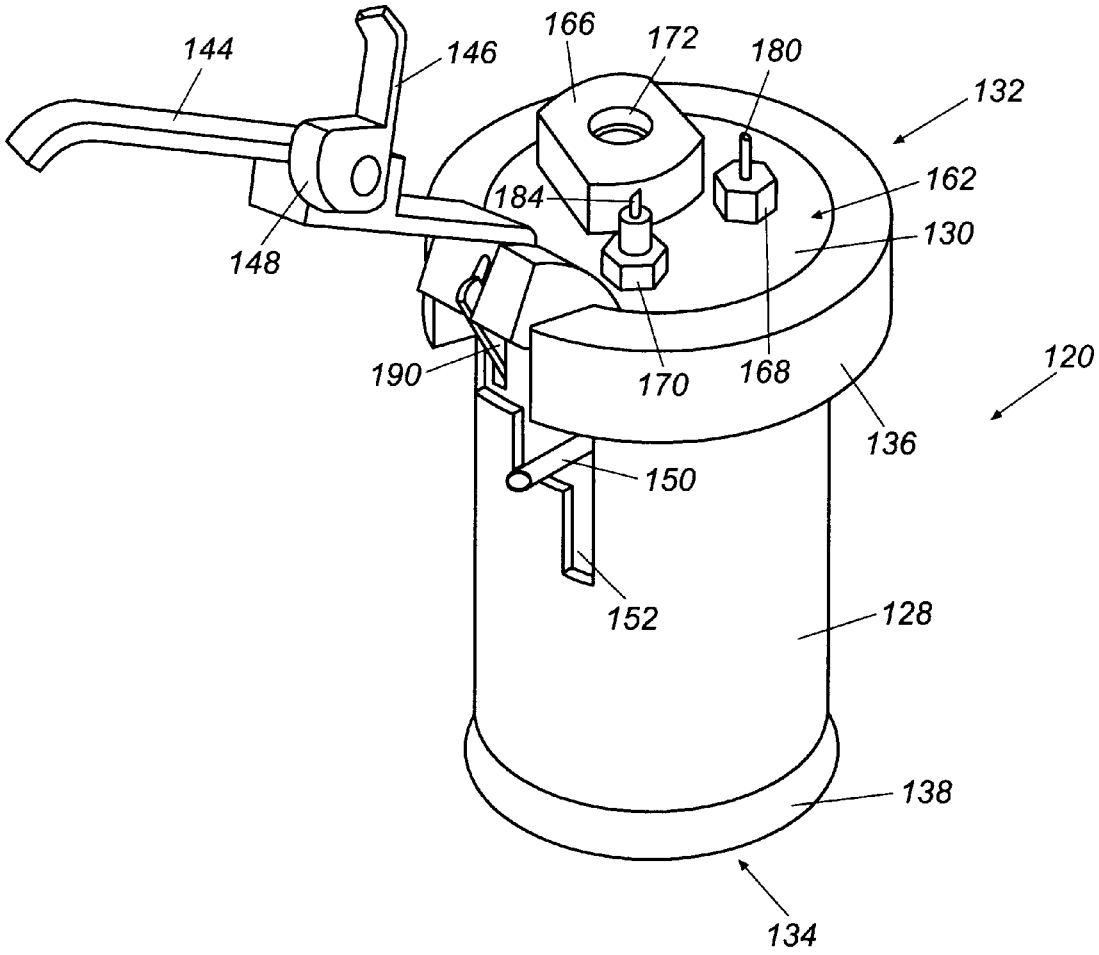
FIG. 10 is an upper perspective view of the bottle coupler of FIGS. 8–9, the coupler being depicted in the open position.

The bottle coupler 120 is shown in detail in FIGS. 8–10. As indicated in these figures, the bottle coupler 120 generally comprises an outer member 128 and an inner member 130 that is slidingly disposed within the outer member. The outer member 128 is substantially tubular in shape so as to be formed as an elongated, hollow cylinder having a first end 132 and a second end 134. Formed at the first and second ends 132 and 134 of the outer member 128 are first and second collars 136 and 138, respectively. As indicated in FIGS. 8 and 9, each of these collars 136, 138 are noncontinuous in nature in that both are interrupted by a notch 140 and 142, respectively. Pivotally connected to the outer member 128 at the notch 140 is a bottle release lever 144. In the closed position of the lever 144 shown in FIG. 8, the lever extends from the first collar 136 of the outer member 128 and generally parallel along the length of the outer member.

Pivotally mounted to the bottle release lever 144 is a needle valve lever 146. The needle valve lever 146 is provided with a cam surface 148 that, when the bottle release lever 144 is in the closed position, normally contacts a needle 150 of a needle valve (not shown) that is located within the inner member 130. This needle 150 extends beyond the outer member 128 through a first opening 152 formed in the side of the outer member. As indicated in FIG. 9, the outer member 128 further includes a second opening 154 that extends from the second notch 142 along a portion of the length of the outer member. For reasons described below, this opening 154 comprises a first portion 156 adapted to receive the mouth 122 of a bottle 118, and a second portion 158 adapted to receive the shoulder 124 of the bottle.

The inner member 130 normally is formed as an elongated, substantially solid cylinder having a first end 162 and a second end 164. Positioned on its first end 162 is liquid outlet port 166, a gas inlet port 168, and a vent port 170. The liquid outlet port 166 is in fluid communication with the bottle 118 mounted thereto through a liquid passage 172 that extends from the outlet port to the second end 164 of the inner member 124 at which point it forms a valve seat 174. Formed within the liquid passage 172 is an internal reservoir 176 that is adapted to hold a predetermined amount of liquid as well as a valve closure member 178 such as a ball that is sized and configured to rest within the valve seat 174.

The gas inlet port 168 similarly is in fluid communication with the bottle 118 through a gas passage 180 that extends from the inlet port to an external conduit 182 that, as shown in FIG. 5, is adapted to extend deep into the bottle 118 when the bottle is mounted to the bottle coupler 120. The vent port 170 is in fluid communication with the needle valve located within the inner member 130 through a vent passage 184. The needle valve, in turn, is selectively placeable in fluid communication with both the liquid passage 172 and the gas passage 180. As indicated in FIG. 9, the second end 164 of the inner member 130 is countersunk so as to form an annular space 186 in which the mouth 122 of a bottle 118 can be disposed. Within this annular space 186 is a gasket 188 that is used to form an airtight seal between the bottle 118 and its coupler 120.

As indicated in FIGS. 8 and 10, the bottle coupler 120 further comprises a link member 190 that is pivotally attached to the bottle release lever 144 at one end, and pivotally attached to the inner member 130 at its other end. In that the pivot point of the lever member 190 is outwardly displaced from the pivot point about which the bottle release lever 144 can pivot, manipulation of the bottle release lever effects linear displacement of the inner member within the outer member. When the lever 144 is in the closed position shown in FIG. 8, the inner member 130 extends downwardly into the first portion 156 of the second opening 154 of the outer member such that a bottle 118 disposed within the annular space 186 cannot be removed therefrom. As the bottle release lever 144 is lifted, however, the link member 190 is displaced so as to effect linear displacement of the inner member 130 along the interior 160 of the outer member 128. FIG. 10 shows the bottle release lever 144 in the fully open position. Once in this position, the second end 164 of the inner member 130 is clear of the first portion 156 of the outer member second opening 154 such that a bottle 118 can be inserted into or removed from the coupler 120.

Figure 7:
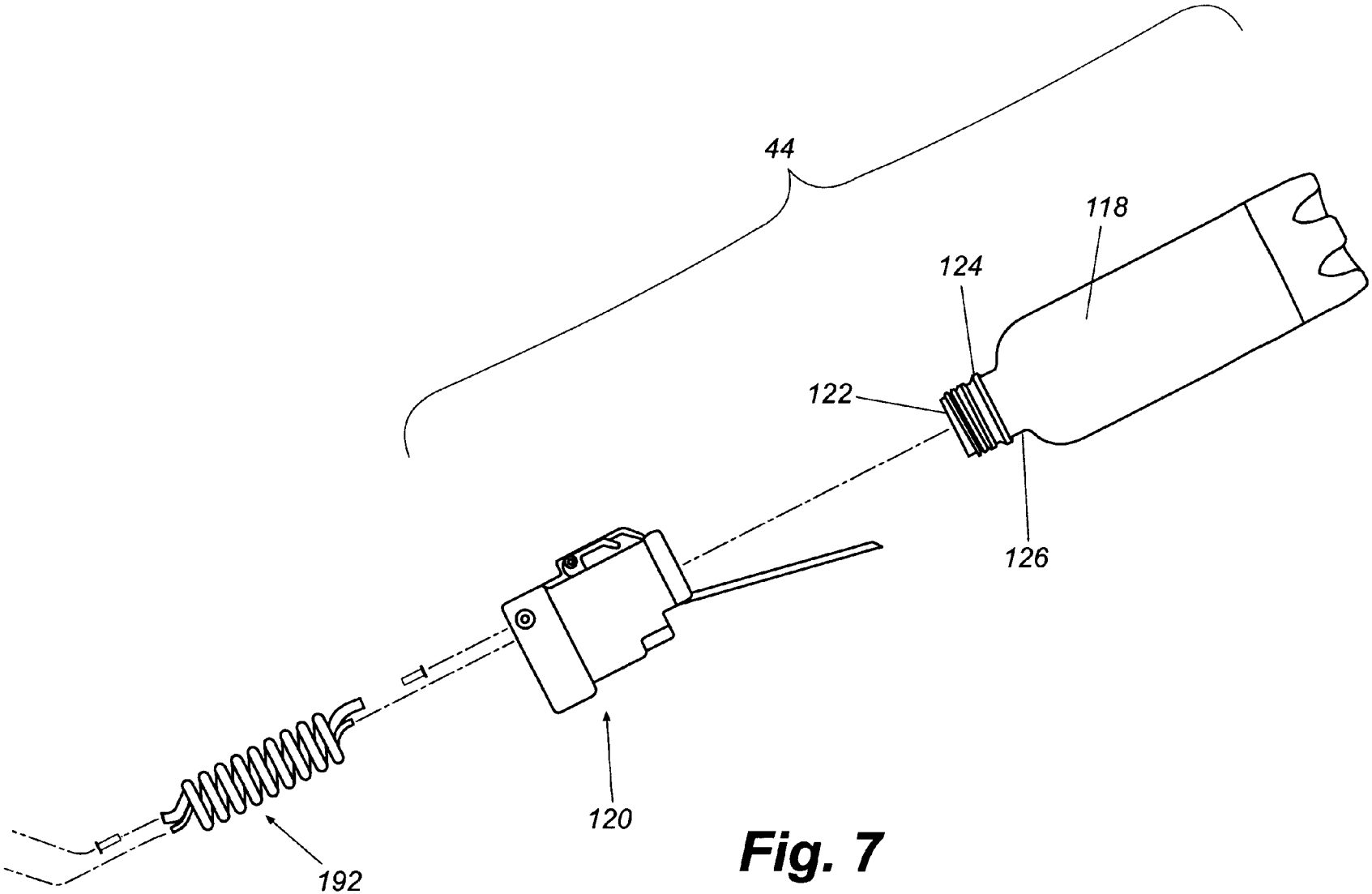
FIG. 7 is an exploded view of a liquid container shown in FIGS. 5–6.

To connect a full bottle 118 of liquid, for example soft drink syrup, to a selected bottle coupler 120, the bottle coupler first is arranged so that it can be attached to the bottle in a manner in which the bottle is maintained in an upright position during connection. Where the beverage dispensing system 10 is integrated into a cart 114 as shown in FIGS. 5 and 6, this step comprises extending the bottle coupler 120 out from the cart interior compartment 116 and inverting the coupler. This extension and reorientation is possible due to the flexible, retractable tubes 192 with which each bottle coupler 120 is connected to the remainder of the system (FIG. 7). Assuming the selected bottle coupler 120 is not presently coupled to a bottle 118, the bottle release lever 142 is moved to the fully open position depicted in FIG. 10 so that the inner member 130 is axially displaced within the outer member 128 towards its first end 132. The mouth 122 and shoulder 124 of the bottle 118 then are positioned into the interior 160 of the outer member 128 by passing the bottle through the second opening 154 formed in the outer member. Once the mouth 122 and shoulder 124 of the bottle are disposed within the interior 160 of the outer member 128, the bottle shoulder will be in abutment with an interior shoulder 194 formed at the second end 132 of the outer member. At this point, the bottle release lever 144 can be moved to the closed position shown in FIG. 8 to axially displace the inner member 130 toward the mouth 122 of the bottle 118 and, eventually, firmly urge the gasket 188 against the mouth of the bottle. If it is not already in the closed position, the needle valve lever 146 can be closed by orienting it in the position shown in FIG. 8. When in this position, the valve needle 150 is in the fully depressed position which opens the gas passage 180 and closes the vent passage 184 such that gas cannot vent out from the bottle. $CO_2$ gas can then flow into the bottle 118 through the external conduit 182 to pressurize the liquid contained within the bottle such that the liquid will flow out from the bottle, along the liquid passage 172, and out through the outlet port 166 when the particular fluid is needed.

If the operator wishes to change the bottle 118 (e.g. if it is empty), the operator first rotates the needle valve lever 146 outwardly. The lever's cam surface 148 is oriented such that, as the lever is rotated, the needle 150 is permitted to extend outwardly from the coupler 120 until, at a predetermined point, the needle valve located within the inner member 130 closes the gas passage 180 and opens the vent passage 184 to the bottle to permit the gas remaining within the bottle to vent to the atmosphere through the vent port 170. At this point, the bottle 118 can be removed from the bottle coupler 120 by again moving the bottle release lever 144 to the fully open position illustrated in FIG. 10.

Figure 11:
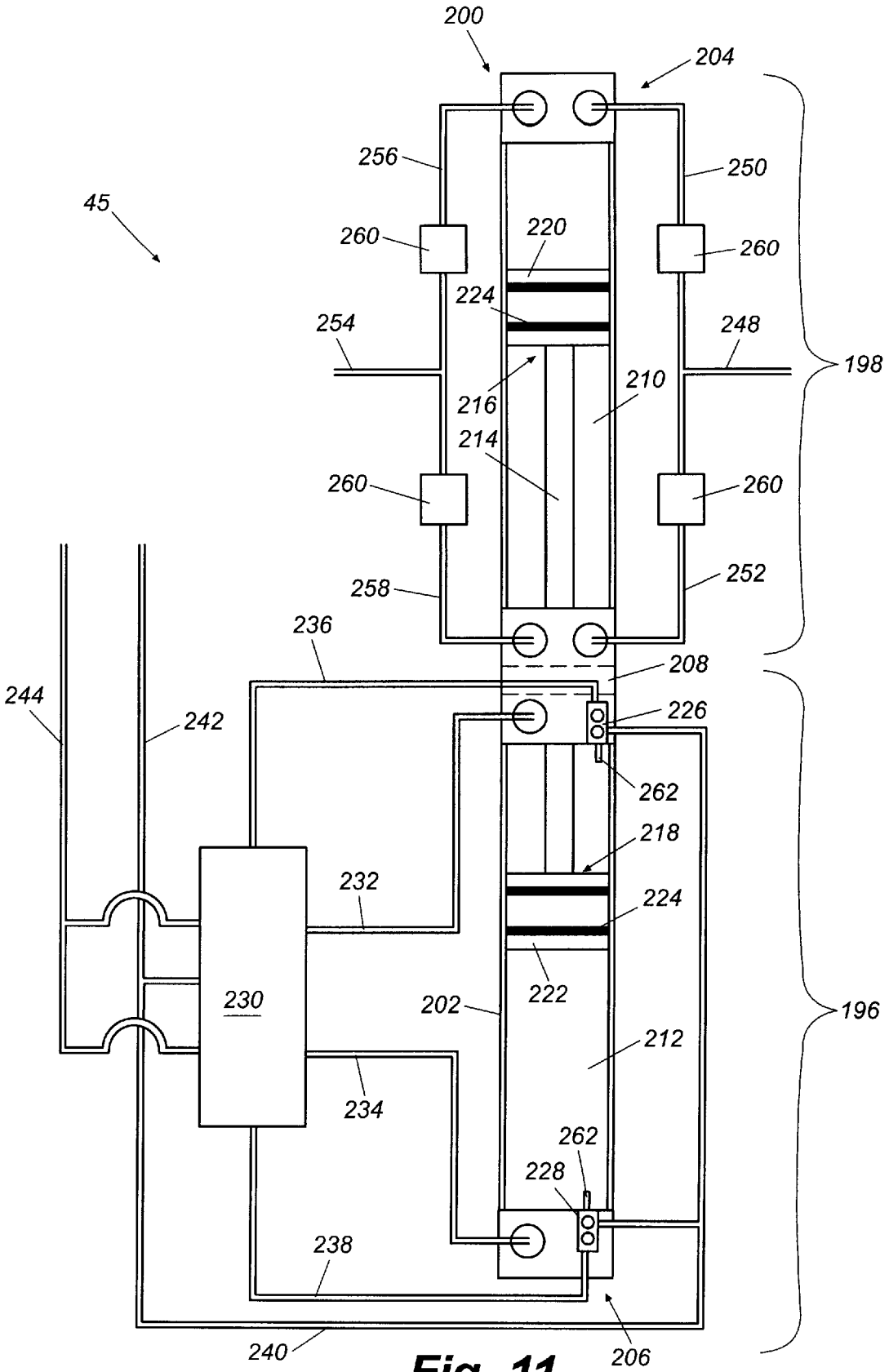
FIG. 11 is a detailed schematic view of a pneumatic pump system shown in FIG. 1.

FIG. 11 illustrates a detailed schematic view of the pneumatic pump system 45 shown in FIG. 1. The pump system 45 generally comprises a gas side 196 and an air side 198. The pneumatic pump system 45 further comprises a double acting pump 200 that extends through both the gas side 196 and the air side 198 of the system. The double acting pump 200 typically is arranged as an elongated cylinder having an outer tube 202 having a first end 204 and a second end 206. Positioned intermediate the first and second ends 204 and 206 is a central dividing member 208 that airtightly separates the pump 200 into a first or air chamber 210 and a second or gas chamber 212. Extending through the central dividing member 208 is a piston rod 214 having first and second ends 216 and 218. Rigidly connected to each of these ends 216, 218 is a first piston head 220 and a second piston head 222. Each of these piston heads 220, 222 is provided with at least one seal that prevents the passage of gas or air around its periphery during use. Disposed within the gas side 196 of the pump 200 are first and second proximity sensors 226 and 228 that, as is described below, send pneumatic signals to a master control valve 230 that controls operation of the pump.

The double acting pump 200 is provided with a plurality of pneumatic line connections schematically represented in FIG. 11. With respect to the gas side 196, the pump 200 is provided with first and second gas supply lines 232 and 234. As shown in the figure, the first gas supply line 232 connects to the pump 200 adjacent the central dividing member 208, and the second gas supply line 234 connects to the pump adjacent its second end 206. These gas supply lines 232, 234 extend from the pump 200 to the master control valve 230. Also connected to the pump 200 on the gas side 196 of the system 45 are first and second signal lines 236 and 238. The first signal line 236 is in fluid communication with the first proximity sensor 226 and the second signal line 238 is in fluid communication with the second proximity sensor 228. As with the gas supply lines 232, 234, the first and second signal lines 236 and 238 similarly connect to the master control valve 230. In addition to their connections to the signal lines 236, 238, the proximity sensors 226, 228 further are in fluid communication with a sensor gas supply line 240. This center gas supply line 240 is connected to a main gas supply line 242 that receives $CO_2$ gas at approximately 45 psi from the second pressure regulator 28. The gas side 196 further includes a vent line 244 which extends from the master control valve 230 to the first vent line 65 (FIG. 1). As indicated in FIG. 1, this vent line 244 normally includes a check valve 246 that is placed between the pneumatic pump system 45 and the diffuser 67 such that high pressure gas venting from the water tank 52 cannot be transported directly to the pneumatic pump system 45.

With respect to the air side 198 of the pneumatic pump system 45, the double acting pump 200 includes an air supply line 248 that, as shown in FIG. 1, is connected to an air filter 250. The air supply line 248 is connected to first and second air passage lines 250 and 252 that connect to the pump 200 at its first end 204 and adjacent the central dividing member 208, respectively. The air side 198 of the pneumatic pump system 45 further includes an air output line 254 that, like the air supply line 248, is connected to two air passage lines, namely a third air passage line 256 and a fourth air passage line 258. Positioned intermediate each of the air passage lines is a check valve 260 which ensures that air can pass through the lines only in a single direction.

The primary components of the pneumatic pump system 45 having been described above, normal operation and use of the system will now be discussed. As identified above, pressurized $CO_2$ gas exits the second pressure regulator 28 and travels down supply line 42 to the pneumatic pump systems main gas supply line 242. The main gas supply line 242 transports this gas to the master control valve 230 which, in turn, either directs this gas into the first gas supply line 232 or the second gas supply line 234, depending upon the desired direction of travel of the second piston head 222. For instance, if it is desired that the second piston head 222 travel toward the central dividing member 208 of the pump system 45, the gas supplied by the main gas supply line 242 is directed into the second gas supply line 234 and, thereby, into the gas chamber 212 adjacent the second end 206 of the pump outer tube 202. As this gas collects in the gas chamber 212, its pressure urges the second piston head 222 toward the air side 198 (upward in FIG. 11). In that the second piston head 222 is fixedly connected to the first piston head 220 with the piston rod 214, this axial displacement of the second piston head effects a similar axial displacement of the first piston head. As the first piston head 220 travels toward the first end 204 of the outer tube, the air in the air chamber 210 is forced outwardly from the outer tube and into the third air passage line 256 such that this air can travel through the check valve 260 and into the air output line 254, and finally into one or more of the liquid containers 44 (FIG. 1). To facilitate this movement of air, and avoid the creation of a vacuum, fresh air is provided to the air chamber 210 behind the first piston head 220 with the second air passage line 252. In particular, air from the atmosphere is taken in through the air filter 250 and supplied to this second air passage line 252 with the air supply line 248.

Once the second piston head 222 within the gas side 196 of the system 45 reaches a point adjacent the central dividing member 208, the piston head makes contact with the first proximity sensor 226. In particular, the piston head depresses a valve needle 262 of the proximity sensor that sends a pneumatic signal along the first signal line 236 to the master control valve 230 to cause the control valve to redirect the high pressure gas supplied by the main gas supply line 242 from the second gas supply line 234 to the first gas supply line 232 so as to urge the second piston head 222 in the opposite direction. As the second piston head 222 travels toward the second end 206 of the pump 200, the gas in front of the piston head is evacuated through the second gas supply line 234 (which previously had supplied high pressure gas to the gas chamber 212). The gas evacuated in this manner through the second gas supply line 234 is directed within the master control valve 230 to the vent line 234 such that this evacuated gas can pass through the check valve 246 and eventually through the diffuser 67 and out to the atmosphere (FIG. 1). As before, travel of the second piston head 222 effects similar travel of the first piston head 220. Accordingly, the first piston head 220 now travels toward the central dividing member 208. As the first piston head 220 travels in this direction, the air within the air chamber 210 is forced outwardly from the outer tube 202 this time through the fourth air passage line 258, through its check valve 260, and finally out through the air output line 254. While the first piston head 220 travels in this direction, the roles of the first and second air passage lines 250 and 252 are reversed, i.e., the first air passage line 250 provides fresh air to the air chamber 210, and the second air passage line 252 is closed by its check valve 260.

Operating in this manner, the pneumatic pump system 45 supplies pressurized air to one or more of the containers 44 such that the liquid contained therein will be urged outwardly therefrom when this liquid is needed. In that air is supplied to these containers 44 as opposed to gas, carbonation of the liquid within these containers can be avoided. Accordingly, the pneumatic pump system 45 is particularly useful for pressurizing containers 44 that contain liquids for non-carbonated drinks such as juices and juice concentrates. It is to be noted, however, that the pneumatic pump system 45 can be used to pressurize all of the containers 44 of the system, if desired.

With reference back to FIG. 1, the first embodiment of the beverage dispensing system 10 can be used to dispense carbonated and noncarbonated mixed beverages, as well as any carbonated and noncarbonated unmixed beverages, in liquid form. To use the system 10, the water tank 52 is filled with water via the water tank refill check valve 62 and water supply line 60. Once the water tank 52 has been filled to an appropriate level, the three-way vent valve 63 is manually switched to the gas open position such that the gas chamber 58 of the tank and the supply line 50 are in open fluid communication with one another.

To initiate the dispensing system 10, the operator opens the shut-off valve 22 of the gas storage tank 20 so that high pressure $CO_2$ gas flows to the three gas pressure regulators 26, 28, and 30. After passing through the first pressure regulator 26, $CO_2$ gas flows into the carbonator tank 16, raising the pressure within the tank to approximately between 90 psi to 110 psi. In addition, this gas is directed to the fourth pressure regulator 35 which then delivers the gas to the water level switch 40. The gas supplied to the water level switch 40 is used, as needed, to send pneumatic pressure signals to the water valve 64. At approximately the same time, the high pressure $CO_2$ gas also flows through the second and third pressure regulators 28 and 30. After passing through the third pressure regulator 30, the high pressure gas passes through the supply line 50, through the three-way vent valve 63, and into the gas chamber 58 of the water tank 52 to fill and pressurize the water within the tank.

As the $CO_2$ gas continues to flow into the gas chamber 58, the water is forced out of the tank 52 and flows through the water supply line 60 to travel to both the carbonator tank water valve 64 and the water pressure regulator 72. The water that passes through the water pressure regulator 72 is piped into and through the flat water supply pipeline 74 to be cooled by the cold plate 48 and, if desired, dispensed through the beverage dispensing valve 18.

Assuming the carbonator tank 16 to initially not contain water, the float member 88 contained therein is positioned near the bottom of the tank and the water tank level switch 40 is in the activated position shown in FIG. 3. Because the water tank level switch 40 is in this activated position, pneumatic pressure is provided to the water valve 64, keeping it in the open position so that water can flow into the carbonator tank 16. As the water continues to flow from the water tank 52 and fills all lines connected thereto, the pressure of the water begins to rise sharply. Eventually, the pressure of the water in the water chamber 56 and the lines in fluid communication therewith reach a pressure equal to that of the high pressure $CO_2$ gas contained in the gas chamber 58. Accordingly, water enters the carbonator tank 16 at high pressure, typically between 195 psi to 200 psi.

Since the carbonator tank 16 is relatively small when compared to the $CO_2$ container and water tank, it fills quickly. Therefore, carbonated water is available soon after the system 10 is initiated. As such, the operator can use the beverage dispensing valve 18, commonly referred to as a "bar gun," to dispense either flat water supplied by the flat water supply line 74 or carbonated water supplied by the carbonated water supply line 82

Once the carbonator tank 16 is full, the water level switch 40 becomes oriented in the inactivated position (FIG. 4), thereby shutting-off the supply of gas to the water valve 64. Not having the pressure signal needed to remain open, the water valve 64 closes, cutting the supply of water to the carbonator tank 16. As the water level within the carbonator tank 16 is again lowered, the water level switch 40 is again activated, restarting the process described above. The system 10 therefore cycles in response to the volume of water contained in the carbonator tank. The cycle occurs repeatedly during use of the system 10, until either the gas or water supplies are depleted. At this time, either or both may be refilled, and the system 10 reinitiated.

Occurring concurrently with the water pressurization and supply described above, the pressurization and supply of the liquid contained in the containers 44 is effected under the influence of pressurized $CO_2$ gas. First, $CO_2$ gas at approximately 45 psi travels from the supply line 42 directly to one or more containers 44. Normally, these containers 44 will contain liquids that are to be used in carbonated drinks, such as soft drink syrups. When one of these liquids is selected by activating the appropriate control on the dispensing valve 18, the supply line 47 is opened to the valve and the liquid flows from its container 44, under the pressure of the $CO_2$ gas, to the dispensing valve. The $CO_2$ gas travelling along the supply line 42 also is directed to the pneumatic pump system 45 which, as described in detail above, pressurizes air and supplies it to selected containers 44. Normally, these containers contain liquids used to make non-carbonated drinks such as juices and the like. The pump 200 of the pump system 45 will continue to cycle back and forth in response to the activation of the proximity sensors 226, 228 until equilibrium is reached between the air chamber 210 and the interior of the bottles 118 that are pressurized therewith. At this point, the pump 200 stalls and will remain so until a demand for more pressurized air is received (e.g. when an amount of liquid is dispensed from one of the containers 44).

So described, the beverage dispensing system 10 of the first embodiment can be used to dispense carbonated and non-carbonated drinks without the need for an external water source or electricity. Accordingly, the system is self-contained and, therefore, well-suited for portable beverage dispensing applications.

Figure 12:
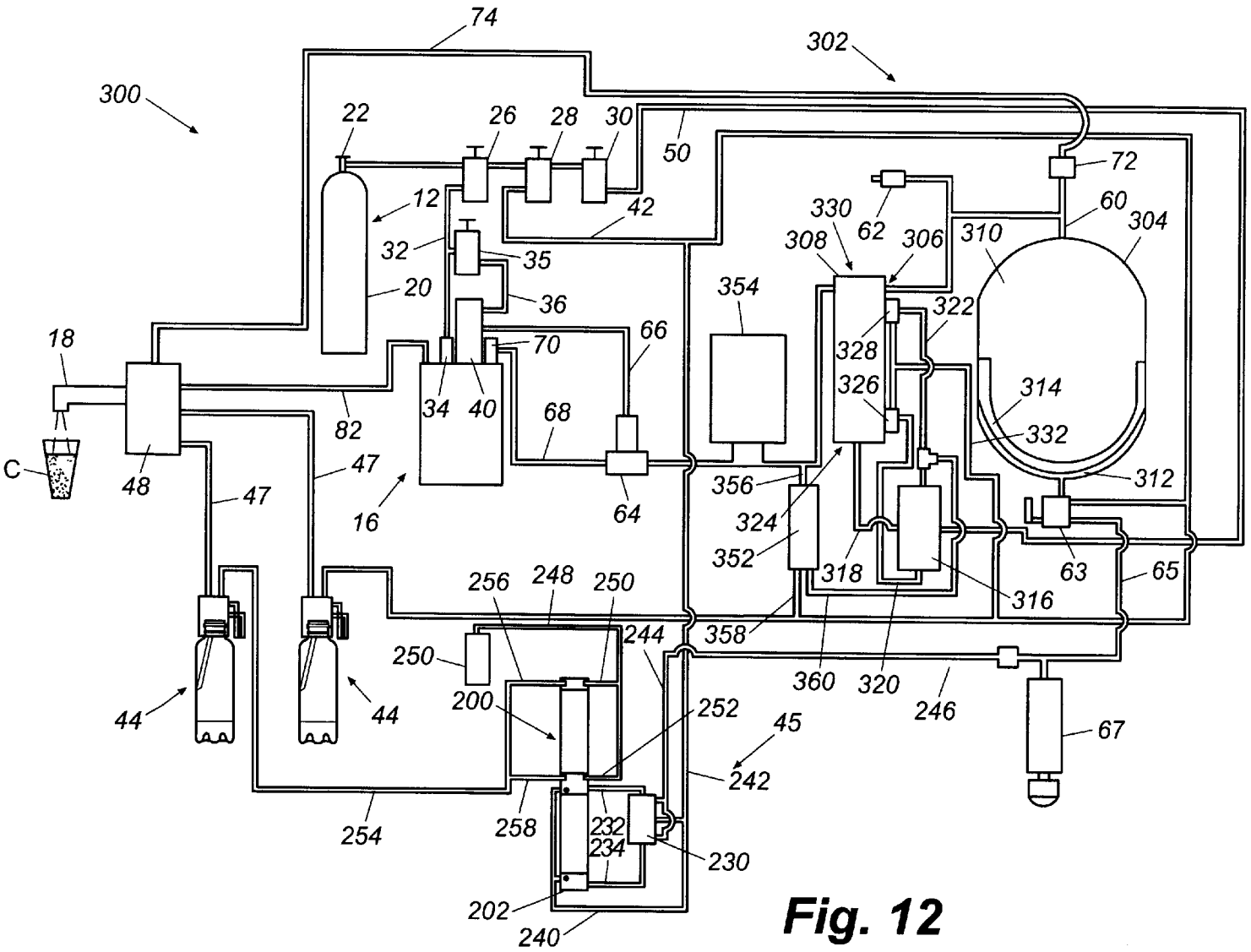
FIG. 12 is a schematic view of a second embodiment of a self-contained pneumatic beverage dispensing system constructed in accordance with the present invention.

FIG. 12 is a schematic view of a second embodiment of a self-contained pneumatic beverage dispensing system 300. Since the second embodiment is substantially similar in structure and function to the system 10 of the first embodiment except as to the source of water and the pressure levels provided to the various components, the following discussion of the second embodiment of the invention is focused on the water source 302 and these pressure levels.

In this second embodiment, the high pressure water tank 52 of the first embodiment is replaced with a low pressure water tank 304 and a high pressure water pump system 306 that includes a pneumatic water pump 308. The low pressure water tank 304 has first and second chambers 310 and 312 that are separated by a pliable diaphragm 314. Since a high pressure pump 308 is included in the system, the water within the water tank 304 need not be at high pressure. Accordingly, instead of being supplied with $CO_2$ gas at approximately between 195 psi to 200 psi, the water tank 304 is supplied with gas at pressures approximately between 25 psi to 60 psi. Since it will not be subjected to high pressure $CO_2$ gas, the low pressure water tank 304 can be constructed of mild steel as opposed to stainless steel which tends to be substantially more expensive. As with the water tank 52 of the first embodiment, pressurized water can leave the first chamber 310 of the tank through a water supply line 60. In one direction, the pressurized water supplied by the water tank 304 flows to the pneumatic water pump 308 to fill the pump with water. In a second direction, the water flows through flat water line 74 to the cold plate 48.

Instead of being directed to the water tank 304, the high pressure gas supplied by supply line 50 is directed to a pneumatic water pump control valve 316. As shown in FIG. 12, in addition to the supply line 50, the control valve 316 is connected to a pump gas supply line 318, and to first and second pneumatic signal lines 320 and 322. The pump gas supply line 318 connects in fluid communication to the pneumatic water pump 308 at its first end 324. The pneumatic signal lines 320, 322 connect to first and second piston sensors 136 and 328, respectively. The first piston sensor 326 is mounted to the pump 308 adjacent its first end 324 and the second piston sensor 328 is mounted to the pump adjacent its second end 330. Each of the piston sensors 326, 328 is connected to a sensor gas supply line 332 which is in fluid communication with the supply line 50

Figure 13:
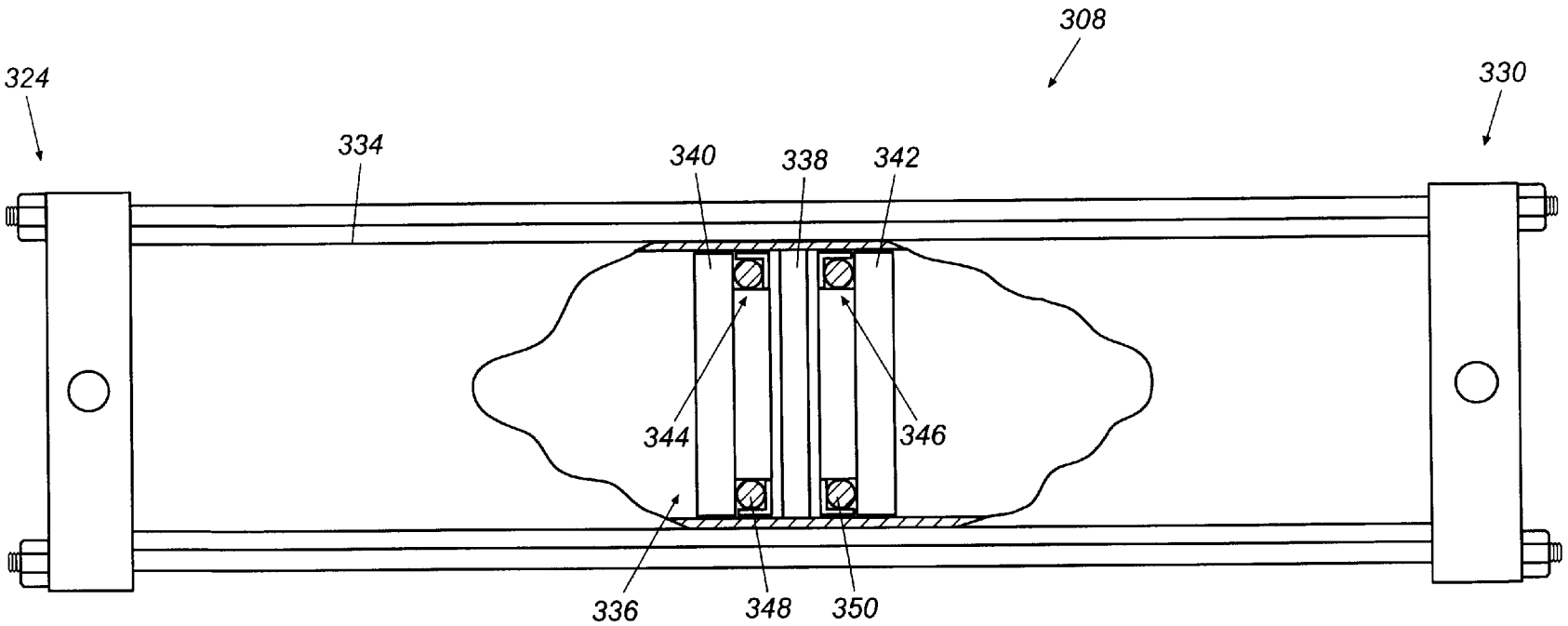
FIG. 13 is a cut-away view of a water pump used in the beverage dispensing system of FIG. 12.

As shown in FIG. 13, the pneumatic water pump 308 comprises a piston cylinder 334 and a rodless piston head 336. The rodless piston head 336 comprises a central magnet 338 that is positioned intermediate two piston end walls 340 and 342. Located between the magnet 338 and each of the end walls 340, 342 are seals 344 and 346. Typically, these seals 344, 346 comprise an inner resilient O-ring 348 and an outer lip seal 350. Configured in this manner, the seals 344, 346 prevent fluids from passing between the piston head 336 and the piston cylinder 334, but permit sliding of the piston head along the cylinder.

In an initial filled state, with the piston head 336 positioned adjacent the first end 324 of the pump, piston sensor 326 senses the proximity of the piston head due to the magnetic attraction therebetween. When such a condition is sensed, the sensor 326 is activated and sends a pneumatic pressure signal to the control valve 316, causing the control valve to open. While in the open position, high pressure gas flows through the control valve 316, along the pump gas supply line 318, and into the gas side of the pump 308. The high pressure gas ejects the water contained on the water side of the piston head 336, eventually pressurizing the water to approximately between 195 psi to 200 psi.

From the pump 308, the pressurized water flows to the carbonator tank 16 similarly as in the first embodiment. When nearly all of the water is driven out of the pump 308 with the piston head 336, the second piston sensor 328 activates in similar manner to the first piston sensor 326, and sends a pneumatic pressure signal to the control valve 316 that causes the valve to cut-off the supply of gas to the pump 308 and vent the pump cylinder 334 so that the relatively low pressure water can again fill the pump. Once the pump 308 is completely filled, the first piston sensor 326 is again activated, and the system cycles again.

Although the system 302, as described above, is believed to be complete and effective, the system can further include a pump reset switch 352 and/or an accumulator tank 354. As shown in FIG. 12, the reset switch 352 receives high pressure water from the pump 308 through water supply line 356. The reset switch also receives low pressure $CO_2$ gas from the supply line 42 through gas supply line 358. Linking the reset switch 352 and the pump control valve 316 is a pneumatic signal line 360 which connects to line 322. So arranged, the pump reset switch ensures that there is adequate amount of carbonated water to meet demand. For instance, if the piston head 336 is positioned at some intermediate point along the length of its stroke and the carbonator tank 16 is filled, shutting off the water valve 64, equilibrium can be achieved, dropping the pressure of the water, therefore indicating that the water pump 308 is not full. Upon sensing this water pressure drop, the reset switch 162 sends a pneumatic pressure signal to the control valve 316, causing the valve to close and vent the gas pressure in the pump so that the pump can be refilled and a full piston stroke then executed.

Another optional component that ensures adequate supply of high pressure water is the accumulator tank 354. The accumulator tank 354 contains an internal diaphragm (not shown) which separates a first chamber of the tank a second chamber of the tank. In the first chamber is a volume of nitrogen gas. In operation, the second chamber fills with high pressure water supplied by the pump 308. As the accumulator tank 354 is filled, the nitrogen gas contained in the first chamber is compressed. In this compressed state, the gas can force the water out of the accumulator tank 354 during situations in which carbonated water demand is high and the pump 308 is in the refill portion of its cycle.

Figure 14:
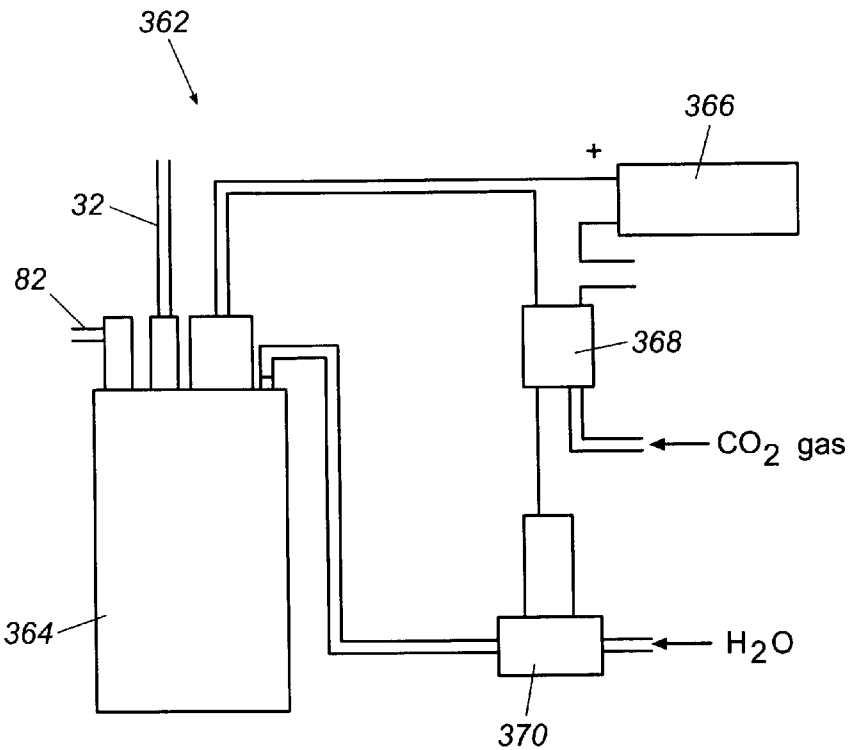
FIG. 14 is a schematic view of a first alternative carbonator tank and filling system.

FIG. 14 illustrates a first alternative carbonator tank and filling system 362 for use in either of the above described dispensing system embodiments. The system 362 comprises a conventional electrically sensed, high pressure carbonator tank 364 and an electric power source 366. Considered suitable for this application is any of the electrically sensed carbonator tanks produced by McCann. To ensure portability, the power source 366 typically comprises a battery. Electrically connected to the carbonator sensor (not shown) are both the power source 366 and a low voltage pneumatic interface valve 368. The interface valve 368 is in fluid communication with both a source of pressurized $CO_2$ gas and a pneumatic water valve 370.

When the electric sensors within the carbonator tank 364 detect that the carbonator tank is not full, the sensors electrically signal the interface valve 368. This signal causes the valve 368 to open and thereby send a pneumatic pressure signal to the pneumatic water valve 370 to cause it to open so that the carbonator tank 364 can be refilled in the manner discussed above.

Figure 15:
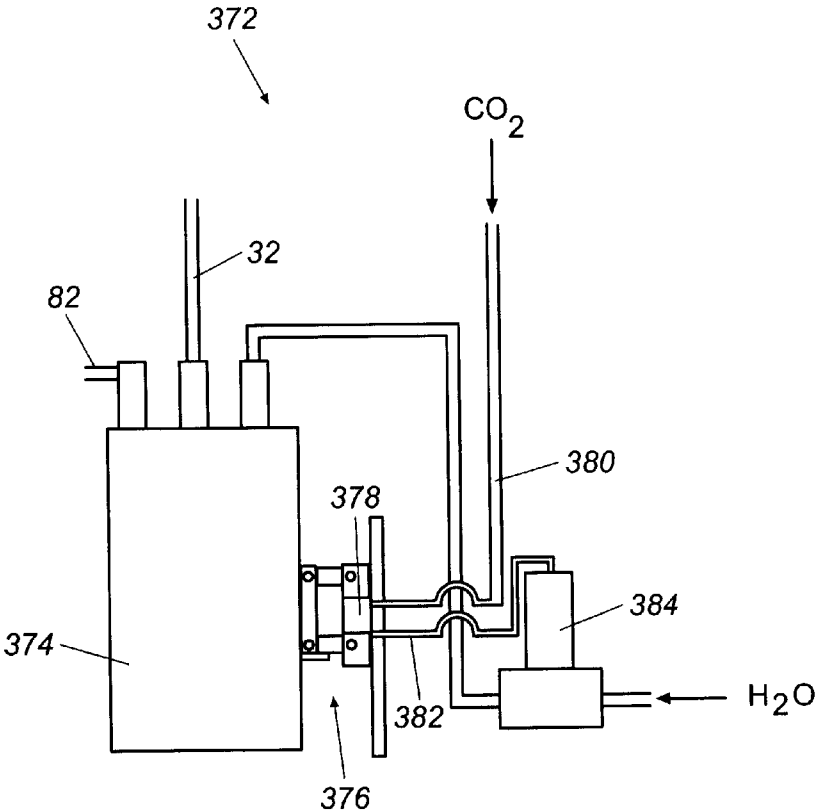
FIG. 15 is a schematic view of a second alternative carbonator tank and filling system.

FIG. 15 illustrates a second alternative carbonator tank and filling system 372 for use with either the beverage dispensing system which comprises a conventional high pressure carbonator tank 374. The carbonator tank 374 is mounted to a vertical surface with a spring loaded carbonator mounting bracket 376. Coupled to this mounting bracket 376 is a pneumatic three-way valve 378 that is in fluid communication with a high pressure $CO_2$ gas supply line 380 and a pneumatic signal line 382 which, in turn, connected to a pneumatic water valve 384.

When the carbonator tank 374 is empty, it is supported by the carbonator mounting bracket 376 in an upright orientation. While in this upright orientation, the pneumatic three-way valve 378 is open, thereby sending a pneumatic pressure signal to the water valve 384 to remain open. Once the tank 374 is nearly full, however, its weight overcomes the strength of the spring within the bracket 376, causing the tank to tilt. This tilting action closes the three-way valve 378, which, in turn, closes the water valve 384 and shuts-off the supply of pressurized water to the carbonator tank 374.

While preferred embodiments of the invention have been disclosed in detail in the foregoing description and drawings, it will be understood by those skilled in the art that variations and modifications thereof can be made without departing from the spirit and scope of the invention as set forth in the claims.

What is claimed is:

1. A self-contained, pneumatic beverage dispensing system, comprising:

a carbonator tank for facilitating absorption of $CO_2$ gas in water to produce carbonated water;

a source of $CO_2$ gas under high pressure, said source of $CO_2$ gas being in fluid communication with said carbonator tank so as to fill said carbonator tank with $CO_2$ gas;

a source of water under high pressure, said source of water being in fluid communication with said carbonator tank so as to fill said carbonator tank with water;

at least two liquid containers for containing liquids to be dispensed by said dispensing system, one of said liquid containers being in fluid communication with said source of $CO_2$ gas; and a pneumatic pump system in fluid communication with said source of $CO_2$ gas and the other of said liquid containers, wherein said pneumatic pump system receives high pressure $CO_2$ gas from said source of $CO_2$ gas and uses it to pressurize air that is supplied to said other of said liquid containers; and a beverage dispensing valve in fluid communication with said carbonator tank and said at least two liquid containers, said dispensing valve used to dispense carbonated water from said carbonator tank and the liquids contained in said at least two liquid containers.

2. The system of claim 1, wherein said source of water comprises a high pressure water tank.

3. The system of claim 1, wherein said source of water includes a low pressure water tank and a water pump in fluid communication with said water tank, said water pump being configured to receive high pressure $CO_2$ gas from said source of $CO_2$ gas and use it to increase the pressure of the water supplied to said water pump by said water tank.

4. The system of claim 1, wherein said pneumatic pump system comprises a pump having an outer tube which forms a first chamber and a second chamber that are separated by a dividing member.

5. The system of claim 4, wherein said pneumatic pump system further comprises first and second piston heads disposed within said first and second chambers, respectively, said piston heads being connected by a piston rod that extends from said first chamber, through said dividing member, and into said second chamber.

6. The system of claim 5, wherein said pneumatic pump system further comprises a master control valve that controls the direction of travel of said first and second piston heads within said outer tube of said pump.

7. The system of claim 6, wherein said pneumatic pump system further comprises first and second proximity switches located within said pump that can sense the position of at least one of said first and second piston heads.

8. The system of claim 7, wherein said proximity sensors are pneumatically operated and send a pneumatic signal to said master control valve when activated.

9. The system of claim 6, wherein said pneumatic pump system further comprises first and second gas supply lines that extend from said master control valve to said pump, said first and second gas supply lines being in fluid communication with said second chamber so as to be capable of individually transporting gas into or out of said second chamber depending upon the desired direction of travel of said second piston head.

10. The system of claim 9, wherein gas is selectively exhausted from said second chamber through said first and second gas supply lines, said exhausted gas passes through a diffuser before being exhausted to the atmosphere.

11. The system of claim 1, wherein at least one of said containers comprises a bottle and a bottle coupler.

12. The system of claim 11, wherein said bottle has a mouth and a shoulder adjacent said mouth.

13. The system of claim 12, wherein said bottle coupler comprises an outer member and an inner member that is slidingly disposed within said outer member.

14. The system of claim 13, wherein said bottle coupler further comprises a bottle release lever that is pivotally attached to said outer member and operably coupled to said inner member such that manipulation of said bottle release lever effects axial displacement of said inner member within said outer member.

15. The system of claim 14, wherein said inner member has first and second ends and a liquid passage, gas passage, and a vent passage, each passage extending from said first end to said second end of said inner member.

16. The system of claim 13, wherein said outer member has an opening that is sized and configured to receive said mouth and shoulder of said bottle.

17. The system of claim 16, wherein said inner member has an annular space formed at its second end that is sized and configured to receive said mouth and shoulder of said bottle.

18. A pneumatic pump system, comprising:

a pump outer tube that is divided into a gas chamber and an air chamber by a dividing member;

a gas piston head disposed in said gas chamber of said pump outer tube, said gas piston head being axially displaceable within said gas chamber;

an air piston head disposed in said air chamber of said pump outer tube, said air piston head being axially displaceable within said air chamber;

a piston rod having first and second ends, said piston rod extending through said dividing member into both chambers of said pump outer tube, said first end being connected to said air piston head and said second end being connected to said gas piston head such that axial displacement of said gas piston head will effect axial displacement of said air piston head.

19. The system of claim 18, further comprising a master control valve that controls the direction of travel of said gas piston head within said gas chamber.

20. The system of claim 19, further comprising first and second gas supply lines that are in fluid communication with said master control valve and said gas chamber, said first and second gas supply lines being connected to said pump at opposite ends of said gas chamber such that high pressure gas can be selectively ported from said master control valve to one of said first and second gas supply lines to control the direction of travel of said gas piston head.

21. The system of claim 20, further comprising first and second proximity sensors that sense the position of said gas piston head within said gas chamber to signal said master control valve as to which gas supply line to supply with high pressure gas.

22. The system of claim 21, wherein said first and second proximity sensors are pneumatically operated and end pneumatic signals to said master control valve.

23. The system of claim 18, further comprising an air supply line that is in fluid communication with said air chamber, wherein air from the atmosphere can be supplied to the air chamber through said air supply line.

24. The system of claim 23, further comprising an air output line that is in fluid communication with said air chamber, said air output line used to transport air pressurized by said system to an appropriate container.

25. A bottle coupler, comprising:

an outer member having first and second ends;

an inner member having first and second ends, said inner member being disposed within said outer member and being axially displaceable therein;

a bottle release lever, said bottle release lever being pivotally attached to said outer member and being operably coupled to said inner member such that when said bottle release lever is manipulated, said inner member is axially displaced within said outer member.

26. The coupler of claim 25, wherein said inner member includes a gas passage, a liquid passage, and a vent passage, each passage extending from said first end to said second end of said inner member such that gas can be transported into a bottle to which said coupler is adapted to attach, liquid can be transported out of the bottle, and residual gas contained in the bottle can be vented therefrom.

27. The coupler of claim 26, wherein said inner member further comprises a needle valve that is in fluid communication with said gas passage and said vent passage, said needle valve being operable to selectively open said gas passage or said vent passage.

28. The coupler of claim 27, further comprising a needle valve lever pivotally mounted to said bottle release lever, and wherein said needle valve includes a needle that extends outwardly from said bottle coupler, wherein manipulation of said needle valve lever can depress said needle to toggle said needle valve between gas open and vent open positions.

29. The coupler of claim 26, wherein said liquid passage includes an interior reservoir.

30. The coupler of claim 29, wherein said liquid passage further includes a valve closure member that is used to close said liquid passage so that liquid cannot be delivered from said coupler to the bottle to which said coupler is adapted to connect.

31. The coupler of claim 25, wherein said outer member includes an opening formed at its second end that is adapted to receive a mouth and shoulder of a bottle to which said coupler is adapted to connect.

32. The coupler of claim 27, wherein said inner member has an annular space formed at its second end that is adapted to receive the mouth and shoulder of the bottle to which said coupler is adapted to connect.

33. The coupler of claim 25, wherein said bottle release lever is coupled to said inner member with a linking member.

* * * * *